United States Patent [19]

Wehr

[11] Patent Number: 4,988,563

[45] Date of Patent: Jan. 29, 1991

[54] THERMAL TRANSFER RIBBON WITH PROTECTIVE LAYER

[76] Inventor: Mary A. Wehr, 2377 Oxford-Middletown Rd., Hamilton, Ohio 45013

[21] Appl. No.: 192,795

[22] Filed: May 10, 1988

[51] Int. Cl.[5] ..... B41M 5/26

[52] U.S. Cl. ..... 428/341; 428/195; 428/207; 428/323; 428/342; 428/484; 428/488.1; 428/522; 428/913; 428/914

[58] Field of Search ..... 428/484, 488.1, 488.4, 428/913, 914, 207, 195, 323, 341, 342, 522

[56] References Cited

U.S. PATENT DOCUMENTS

| | | | |
|---|---|---|---|
| 3,527,666 | 9/1970 | Labes | 161/161 |
| 4,053,660 | 10/1977 | Hurwitz et al. | 428/914 |
| 4,479,997 | 10/1984 | Masterson et al. | 428/484 |
| 4,597,793 | 7/1986 | Amon et al. | 106/21 |
| 4,599,111 | 7/1986 | Amon et al. | 106/21 |
| 4,599,260 | 7/1986 | Truskolaski et al. | 428/207 |
| 4,627,997 | 12/1986 | Ide | 428/914 |
| 4,698,268 | 10/1987 | Ueyama | 428/488.4 |

*Primary Examiner*—Pamela R. Schwartz

[57] ABSTRACT

A thermal transfer ribbon includes a substrate which has a thermal sensitive coating and a protective coating. The thermal sensitive coating is a wax mixture dispersed in a binder mix along with pigments. The protective coating is a wax-copolymer mixture for substantially reducing or eliminating ribbon offset.

9 Claims, 2 Drawing Sheets

THERMAL TRANSFER RIBBON WITH PROTECTIVE LAYER

BACKGROUND OF THE INVENTION

In the printing field, the impact type printer has been the predominant apparatus for providing increased throughput of printed information. The impact printers have included the dot matrix type wherein individual print wires are driven from a home position to a printing position by individual and separate drivers. The impact printers also have included the full character type wherein individual type elements are caused to be driven against a ribbon and paper or like record media adjacent and in contact with a platen.

The typical and well-known arrangement in a printing operation provides for transfer of a portion of the ink from the ribbon to result in a mark or image on the paper. Another arrangement includes the use of carbonless paper wherein the impact from a print wire or a type element causes rupture of encapsulated material for marking the paper. Also known are printing inks which contain magnetic particles wherein certain of the particles are transferred to the record media for encoding characters in manner and fashion so as to be machine readable in a subsequent operation. One of the known encoding systems is MICR (Magnetic Ink Character Recognition) utilizing the manner of operation as just mentioned.

While the impact printing method has dominated the industry, one disadvantage of this type of printing is the noise level which is attained during printing operation. Many efforts have been made to reduce the high noise levels by use of sound absorbing or cushioning materials or by isolating the printing apparatus.

More recently, the advent of thermal printing which effectively and significantly reduces the noise levels has brought about the requirements for heating of extremely precise areas of the record media by use of relatively high currents. The intense heating of the localized areas causes transfer of ink from a ribbon onto the paper or like receiving media. Alternatively, the paper may be of the thermal type which includes materials that are responsive to the generated heat.

The use of thermal transfer printing, especially when printing in a serial manner, can result in ribbon offset to unprinted areas of the receiving substrate. Ribbon offset is a term used to describe the unintentional transfer of ink from the ribbon onto unprinted areas of the paper or other record media which is adjacent the ribbon during printing operation. This ribbon offset can make character recognition, such as OCR (Optical Character Recognition) or MICR (Magnetic Ink Character Recognition), difficult and sometimes impossible.

The present invention provides a thermal transfer medium in the preferred form of a ribbon which eliminates or substantially reduces ribbon offset during the printing operation.

Representative documentation in the area of nonimpact printing includes U.S. Pat. No. 3,527,666, issued to M. M. Labes on Sept. 8, 1970, which discloses pressure sensitive copying material having a carrier layer impregnated with an image forming material and a transfer layer having a plurality of capillary pores therein for receiving and retaining the image-forming material from the carrier layer at different rates.

U.S. Pat. No. 4,597,793, issued to A. Amon et al. on July 1, 1986, discloses a desensitizing ink for wet offset printing on an acceptor surface of a chemical duplicating set having at least two superimposed sheets, one of the facing surfaces of which has an electrophilic acceptor coating and the other a nucleophilic coating capable of producing a chromogenic reaction to form a fine stable emulsion of water in the ink.

U.S. Pat. No. 4,599,111, issued to A. Amon et al. on July 8, 1986, discloses a desensitizing ink for wet offset printing on an acceptor surface of a chemical duplicating set wherein a nucleophilic alkoxylated compound is bridged as a polyurethane to increase its molecular weight and to improve ink transfer.

U.S. Pat. No. 4,599,260, issued to B. S. Truskolaski et al. on July 8, 1986, discloses a directly printable tape comprising a polymeric film backing having a low adhesive backsize coating on one surface and a pressure-sensitive adhesive on the other surface. The backsize coating is ink imprintable and is low-force removable from the adhesive without transfer of ink thereto.

SUMMARY OF THE INVENTION

The present invention relates to nonimpact printing. More particularly, the invention provides a coating formulation or composition and a thermal ribbon or transfer medium for use in imaging or encoding characters, bar codes or other marks on paper or like record media documents which enable machine, or human, or reflectance reading of the imaged or encoded characters. The thermal transfer ribbon enables printing in quiet and efficient manner and makes use of the advantages of thermal printing on documents with a signal inducible ink.

The ribbon comprises a thin, smooth substrate such as tissue-type paper or polyester-type plastic on which is applied a thermal sensitive layer or coating that generally includes a wax mixture dispersed in a binding mix of an ethylene copolymer or a hydrocarbon resin to form the wax emulsion. The hydrocarbon resin and the solids of the wax emulsion are mixed or dispersed into solution with dyes and coloring pigments in an attritor or other conventional dispersing equipment. The coloring pigments or dyes may include colors such as magenta, cyan, yellow or black and such pigments may also include a magnetic oxide. The thermal sensitive coating is then applied to the substrate by well-known or conventional coating techniques.

A protective layer or coating is applied over the thermal sensitive coating to substantially reduce or eliminate ribbon offset of a serially printed magnetic or a nonmagnetic thermal transfer ribbon. A preferred formulation of the protective coating comprises a mixture of approximately 50% ethylenevinyl acetate copolymer and approximately 50% paraffin wax which is applied on the thermal reactive coating at a weight of about 1.5 milligrams per square inch. The thermal transfer ribbon comprises the substrate, the thermal functional coating, and the protective layer to provide clear characters or marks on the paper or record media.

In view of the above discussion, a principal object of the present invention is to provide a ribbon including a thermal-responsive coating thereon.

Another object of the present invention is to provide a thermal transfer ribbon substrate including a coating thereon for use in imaging or encoding operations.

An additional object of the present invention is to provide a coating on a ribbon substrate having ingredients in the coating which are responsive to heat for transferring a portion of the coating to paper or like record media.

A further object of the present invention is to provide a coating on a ribbon substrate, which coating includes a pigment material and a wax emulsion dispersed in a binder mix and which is responsive to heat for transferring the coating in precise printing manner to paper or like record media.

Still another object of the present invention is to provide a thermally-activated coating on a ribbon that is completely transferred from the base of the ribbon onto the paper or document in an imaging operation in printing manner at precise positions and during the time when the thermal elements are activated to produce a well-defined and precise or sharp image.

Still an additional object of the present invention is to provide a thermal sensitive coating consisting essentially of a wax emulsion and a protective layer or coating on the thermal reactive coating to prevent ribbon offset to unprinted areas.

Still a further object of the present invention is to provide a two stage process which includes the preparation of a specific wax emulsion and the preparation of a protective coating for use in thermal printing.

Still another object of the present invention is to provide a heat sensitive, transfer ribbon created by use of copolymers or hydrocarbon resins, waxes, oxides, and pigments or dyes to transfer a sharp image from a tissue or a polyester base substrate in a temperature range of 50° C. to 125° C. without ribbon offset of images.

Additional advantages and features of the present invention will become apparent and fully understood from a reading of the following description taken together with the annexed drawing.

DESCRIPTION OF THE PREFERRED EMBODIMENT

Figure 1:
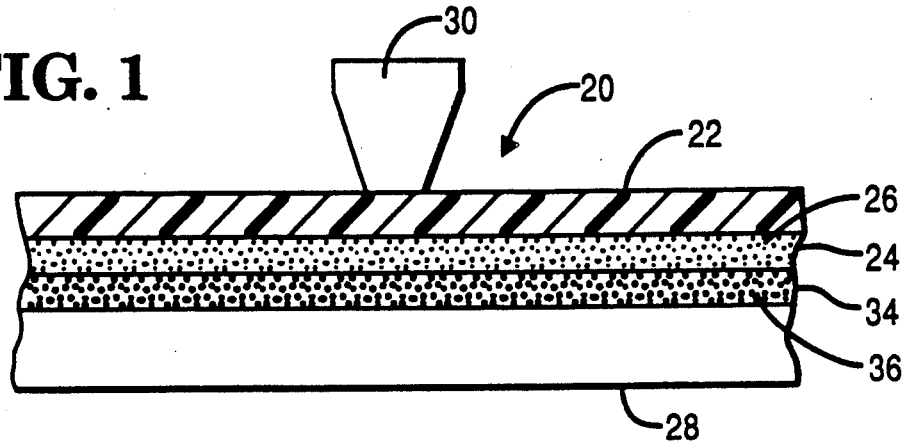
FIG. 1 illustrates a thermal element operating with a ribbon base having a transfer coating and a protective coating thereon incorporating the ingredients as disclosed in the present invention.
Figure 2:
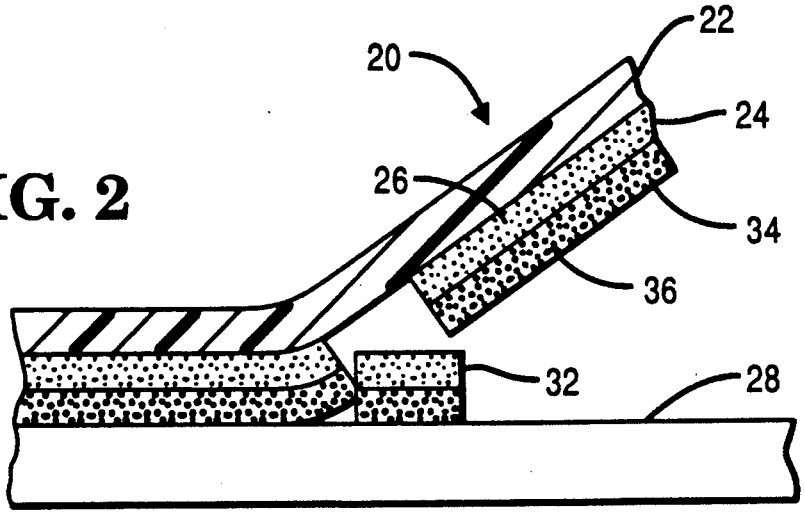
FIG. 2 shows the receiving paper with a part of the coatings transferred in the form of a character or other mark onto the receiving paper.

The transfer ribbon 20, as illustrated in FIGS. 1 and 2, comprises a base or substrate 22 of thin, smooth, tissue-type paper or polyester-type plastic or like material having a coating 24 which is thermally activated and includes either magnetic or nonmagnetic pigment or particles 26 as an ingredient therein for use in imaging or encoding operations to enable machine reading, or human reading, or reflectance reading, of characters or other marks. Each character that is imaged on a receiving paper 28 or like record media produces a unique pattern or image that is recognized and read by the reader. In the case of thermal transfer ribbons relying on the nonmagnetic thermal printing concept, the pigment or particles 26 include coloring materials such as pigments, fillers and dyes. In the case of ribbons relying on the magnetic thermal printing concept, the pigment or particles 26 include magnetic oxides or like sensible materials.

As alluded to above, it is noted that the use of a thermal printer having a print head element, as 30, substantially reduces noise levels in the printing operation and provides reliability in imaging or encoding of paper or like documents 28. The thermal transfer ribbon 20 provides the advantages of thermal printing while encoding or imaging the document 28 with a magnetic or with a nonmagnetic signal inducible ink. When the heating elements 30 of a thermal print head are activated, the imaging or encoding operation requires that the pigment or particles of material 26 on the coated ribbon 20 be transferred from the ribbon to the document 28 in manner and form to produce precisely defined characters 32 for recognition by the reader. In the case of nonmagnetic thermal printing, the imaging or encoding material 26 is transferred to the document 28 to produce precisely defined characters or marks 32 for recognition and for machine, human, or reflectance reading thereof.

In the case of magnetic thermal printing, the thermal sensitive coating 24 includes magnetic pigment or particles 26 for use in imaging or encoding operations to enable optical, human, or machine reading of the characters. The magnetic thermal transfer ribbon 20 provides the advantages of thermal printing while encoding or imaging the document 28 with a magnetic signal inducible ink.

The thermal transfer ribbon of the present invention is produced in a two coating or layer process wherein the first coating 24 is a thermal functional coating and includes a specific wax emulsion or formulation, and the second coating 34 is a protective coating or layer.

The protective coating or layer 34 includes particles of material 36 and is provided on the thermal reactive coating 24 on the side away or distal from the ribbon substrate 22, as seen in FIGS. 1 and 2. The protective coating 34 exhibits the following characteristics, namely, the coating 34 must be resistant to rubbing and smudging, the coating must not inhibit transfer of the thermal-sensitive material 26 in the coating 24 at normal print head voltage, pulse width and temperature, and the coating 34 must provide a bond between the thermal-sensitive material 26 in the coating 24 and the receiving paper 28 after transfer of such material.

Figure 3:
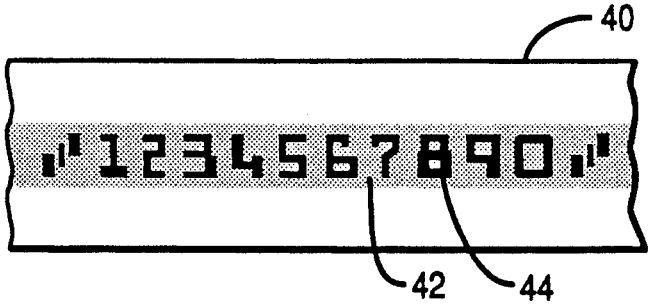
FIG. 3 is a diagrammatic view of a portion of a thermal material receiving medium wherein ribbon offset occurs in unprinted areas.

FIG. 3 shows a portion of a document 40 with a strip portion 42 of the document and several of the thermally transferred characters 44. The ribbon offset is illustrated as the darkened area strip portion 42 in the unprinted areas adjacent the characters 44.

Figure 4:
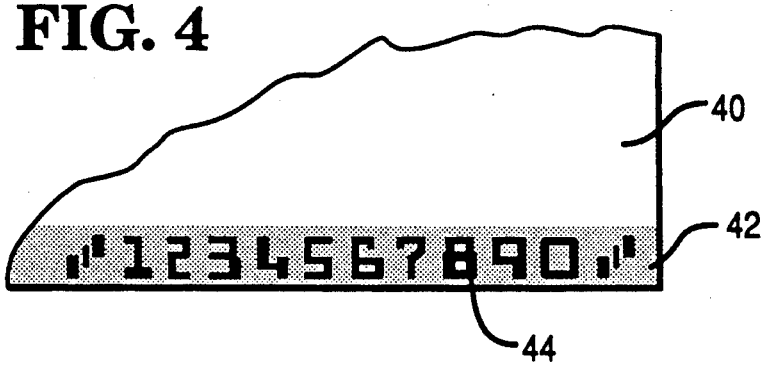
FIG. 4 is a view of a portion of a document showing ribbon offset in the unprinted areas.

FIG. 4 shows a portion of a document 40 such as a bank check having a plurality of encoded characters 44 along the lower edge of the check. The darkened strip portion 42 surrounding the characters is illustrated as an example of ribbon offset on a printed document, as 40, using a ribbon without a protective layer or coating.

Figure 5:
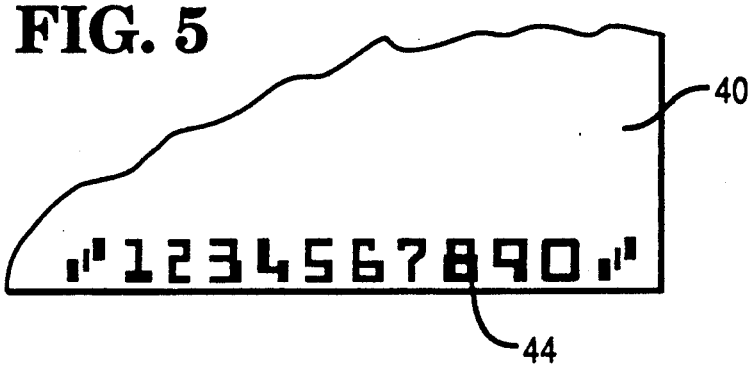
FIG. 5 is a similar view of a portion of a document when using the protective coated or layered ribbon of the present invention.

FIG. 5 shows the portion of the document 40 with the encoded characters 44 and illustrating an example of a printed document using a ribbon with the protective layer or coating 34. The protective layer 34 substantially reduces or prevents ribbon offset during printing or encoding operations.

The thermal functional coating 24 includes wax emulsion ingredients and thermal coating ingredients. A wax adhesive emulsion of 20–30% solids uses hydrocarbon wax, paraffin wax, carnauba wax, microcrystalline wax and ethylene/vinyl acetate copolymer or a hydrocarbon resin soluble in aliphatic solvents. The thermal transfer coating ingredients may include an oxide, a transfer agent, an additive, and a pigment which are added to the wax emulsion.

A preferred wax emulsion or formulation to satisfy the requirements of the first coating or the thermal functional coating 24 includes the ingredients in appropriate amounts as set forth in Tables 1 and 2 of Example I.

TABLE 1

| Wax Emulsion | Percent Dry | Range |
|---|---|---|
| Paraffin 162 Wax | 42 | 25-65% |
| WB-17 Wax | 21 | 5-35% |
| Carnauba #3 Wax | 12 | 5-35% |
| Elvax 210 | 20 | 5-25% |
| Polywax 1000 | 5 | 0-20% |
| Mineral Spirits | — | — |
| | 100.0 | |
| 20-30% Solids | | |

TABLE 2

| Ingredient | Percent Dry | Range |
|---|---|---|
| Wax Emulsion (from above) | 40 | 35-90% |
| Iron Oxide | 40 | 0-55% |
| Sucrose Benzoate | 20 | 0-25% |
| X-14 Oleate | 0 | 0-5% |
| Permablak LS-60 | 0 | 0-35% |
| | 100.0 | |
| 25-50% Solids | | |

The nonvolatile or solid materials in the above formulation for the thermal transfer coating 24 are controlled or kept within a range of 25% to 55%, and it is here noted that Lacolene, or VM and P Naptha, can be substituted in place of the mineral spirits. The wax adhesive emulsion is heated to 200° F. for a period of about 15 minutes while mixing the above solution and then is allowed to cool to 110° F. at the end of the first stage of the process. After cooling the wax emulsion of Table 1 to 110° F., the ingredients of Table 2 are added to the emulsion using conventional grinding or dispersing equipment.

A preferred formulation for the protective layer 34 is made as an emulsion with the ingredients in appropriate amounts as set forth in Table 3 of Example I.

TABLE 3

| Protective Coating | Percent Dry | Range |
|---|---|---|
| Elvax 210 | 50 | 10-60% |
| Paraffin 162 Wax | 50 | 40-90% |
| Mineral Spirits | — | — |
| | 100.0 | |
| 5-35% Solids | | |

The ingredients of the wax emulsion in Table 1, the ingredients in Table 2, and the ingredients of the protective coating in Table 3 are dry weight percentages used in making the formulations for the thermal functional coating 24 and for the protective coating 34.

Paraffin 162 wax is a mixture of solid hydrocarbons chiefly of the methane series derived from the paraffin distillate portion of crude petroleum and is soluble in benzene, ligroine, alcohol, chloroform, turpentine, carbon disulfide and olive oil. WB-17 is an oxidized, isocyanated hydrocarbon wax. Carnauba #3 is a hard, amorphous wax derived by exudation from leaves of the wax palm and is soluble in ether, boiling alcohol and alkalies. Elvax 210 is an ethylene vinyl acetate copolymer of high vinyl acetate content that is used as binding material. Different color (magenta, cyan, yellow or black) dyes or pigments can be mixed into the formulation to provide proper color or toning for monochrome printing or for color printing. Magnetic oxide is preferred as a pigment or sensible material in the magnetic style ribbon for MICR printing. Polywax 1000 is a low molecular weight polyethylene. Iron oxide is a reddish or bluish-black (or brown or brownish-black) amorphous powder, soluble in acids, insoluble in water, alcohol and ether, and is used as a pigment or sensible material. Sucrose benzoate is a transfer agent that is compatible with waxes and copolymers. X-14 oleate is used as a filler and also as a coloring agent. Permablak LS-60 is a black amorphous powder of relatively coarse particles, insoluble in solvents and is used as a pigment. It is noted that a pigment is defined as a solid that reflects light of certain wavelengths, without producing appreciable luminescence; in effect, pigments are used to impart color to other materials.

The nonvolatile materials of the thermal transfer coating 24 are controlled or kept within a range of 25-55% for proper viscosity. It should be noted that all ingredients are carefully weighed and solubilized in the mineral spirits using appropriate heat and agitation. After the solution is complete, it is slowly cooled to form a viscous wax dispersion to prepare a thermally active, transfer coating.

The substrate or base 22, which may be 30-40 gauge capacitor tissue, manufactured by Glatz, or 14-35 gauge polyester film as manufactured by E. I. duPont under the trademark Mylar, should have a high tensile strength to provide for ease in handling and coating of the substrate. Additionally, the substrate should have properties of minimum thickness and low heat resistance to prolong the life of the heating elements 30 of the thermal print head by reason of reduced print head actuating voltage and the resultant reduction in burn time.

The thermal functional coating 24 is applied to the substrate 22 by means of conventional coating techniques such as a Meyer rod or like wire-wound doctor bar set up on a typical solvent coating machine to provide a coating weight of between 9 and 16 milligrams per four square inches (4 to 11 grams per square meter). An overall coating thickness of 0.0005 to 0.0008 inches includes the protective coating of between 4 and 8 milligrams per four square inches (2 to 5 grams per square meter).

The coating 24 is made up of approximately 25-55% nonvolatile material and is maintained at a desired temperature and viscosity throughout the coating process. A temperature of 40° to 50° C. is maintained during the entire coating process. After the thermal functional coating 24 is applied to the substrate 22 and the protective layer 34 is applied to the coating 24, the web of ribbon 20 is passed through a dryer at an elevated temperature in the range between 80° and 120° C. for approximately 5-10 seconds to ensure good drying and adherence of the protective layer 34 on the thermal coating 24 and of the thermal coating 24 onto the substrate 22 in making the transfer ribbon 20. The above-mentioned coating weight, as applied by the Meyer rod onto a preferred 4-7 microns thick substrate, overall translates to a total thickness of 7-14 microns. The thermal functional coating 24 can be fully transferred onto the receiving substrate 28 in the range of 50°-120° C. by changing the ranges of the waxes used in the wax adhesive emulsion portion of the coating.

The availability of the various ingredients used in the present invention is provided by the following list of companies.

| Material | Supplier |
|---|---|
| WB-17 Wax | Bareco |
| Paraffin 162 Wax | Boler |
| Carnauba #3 Wax | Baldini & Co., Inc. |
| Elvax 210 Wax | E. I. duPont |
| Polywax 1000 | Bareco |
| Iron Oxide | BASF |
| Sucrose Benzoate | Velsicol |
| X-14 Oleate | BASF |
| Permablak LS-60 | Mono-Chem |
| Mineral Spirits | Ashland Chemical Co. |
| Magenta Dye | Day-Glo |
| Cyan Dye | Day-Glo |
| Calcium Carbonate | Omya |
| ARC Yellow Dye | Day-Glo |

It is thus seen that herein shown and described is a thermal transfer ribbon for use in thermal printing operations which includes a thermal responsive coating on one surface of a substrate and a protective layer over the coating. The coated ribbon enables transfer of coating material onto documents or like record media during the printing operations to form characters or other marks on the media in an imaging or in an encoding nature, permitting machine or other reading of the characters. A protective coating is provided over the thermal responsive coating to resist smudging or ribbon offset during the printing operations. The present invention enables the accomplishment of the objects and advantages mentioned above, and while a preferred embodiment has been disclosed herein, variations thereof may occur to those skilled in the art. It is contemplated that all such variations and any modifications not departing from the spirit and scope of the invention hereof are to be construed in accordance with the following claims.

What is claimed is:

1. A thermal transfer ribbon comprising a substrate, a thermal sensitive coating covering the substrate on one side thereof and which thermal sensitive coating is a mixture containing as essential ingredients about 5 to 35% hydrocarbon wax, about 25 to 65% paraffin wax, about 5 to 35% carnauba wax, binding material of about 5 to 25% ethylene vinyl acetate copolymer, sensible material of about 1 to 55% iron oxide, a pigment of about 1 to 35% black amorphous powder and a transfer agent of about 1 to 25% sucrose benzoate, all by dry weight, and a protective layer covering the thermal sensitive coating on the side thereof distal from the substrate and containing as essential ingredients binding material of about 10 to 60% ethylene vinyl acetate copolymer and about 40 to 90% paraffin wax, by dry weight.

2. The thermal transfer ribbon of claim 1 wherein the thermal sensitive coating includes about 1 to 20% polyethylene.

3. The thermal transfer ribbon of claim 1 wherein the thermal sensitive coating includes about 1 to 5% oleate.

4. The thermal transfer ribbon of claim 1 wherein the thermal sensitive coating has a weight of about 4 to 11 grams per square meter.

5. The thermal transfer ribbon of claim 1 wherein the protective layer has a weight of about 2 to 5 grams per square meter.

6. THe thermal transfer ribbon of claim 1 wherein the hydrocarbon wax is an oxidized, isocyanated wax.

7. The thermal transfer ribbon of claim 1 wherein the paraffin wax comprises a mixture of solid hydrocarbons of the methane series.

8. A thermal transfer ribbon for use in nonimpact printing comprising a substrate, a functional coating covering the substrate on one side thereof and which functional coating is a mixture containing as essential ingredients about 5 to 35% hydrocarbon wax, about 25 to 65% paraffin wax, about 5 to 35% carnauba wax, about 1 to 20% low molecular weight polyethylene, binding material of about 5 to 25% ethylene vinyl acetate copolymer, sensible material of about 1 to 55% iron oxide, a pigment of about 1 to 35% black amorphous powder and a transfer agent of about 1 to 25% sucrose benzoate, all by dry weight, and a protective layer covering the functional coating on the side thereof distal from the substrate and containing as essential ingredients binding material of about 10 to 60% ethylene vinyl acetate copolymer and about 40 to 90% paraffin wax, by dry weight.

9. The thermal transfer ribbon of claim 8 wherein the functional coating includes about 1 to 5% oleate.

* * * * *

UNITED STATES PATENT AND TRADEMARK OFFICE

CERTIFICATE OF CORRECTION

PATENT NO. : 4,988,563

DATED : January 29, 1991

INVENTOR(S) : Mary Ann Wehr

It is certified that error appears in the above-identified patent and that said Letters Patent is hereby corrected as shown below:

ON THE TITLE PAGE:

insert --[73] Assignee: NCR Corporation, Dayton, Ohio-- item [76] Inventor: "Mary A. Wehr, 2377 Oxford-Middletown Rd., Hamilton, Ohio 45013" should be --Mary Ann Wehr, 2377 Oxford-Middletown Rd., Hamilton, Ohio 45013-- before item [57] add --Attorney, Agent, or Firm - Wilbert Hawk, Jr.; Albert L. Sessler, Jr.; George J. Muckenthaler--.

Signed and Sealed this

Twenty-eighth Day of July, 1992

*Attest:*

DOUGLAS B. COMER

*Attesting Officer*

*Acting Commissioner of Patents and Trademarks*